US007278247B2

(12) United States Patent
Baumgartner

(10) Patent No.: US 7,278,247 B2
(45) Date of Patent: Oct. 9, 2007

(54) METHOD AND APPARATUS FOR REPLACING A UTILITY POLE

(76) Inventor: Gary Baumgartner, 23033 Audrain Rd., #814, Mexico, MO (US) 65265

( * ) Notice: Subject to any disclaimer, the term of this patent is extended or adjusted under 35 U.S.C. 154(b) by 467 days.

(21) Appl. No.: 10/841,890

(22) Filed: May 7, 2004

(65) Prior Publication Data

US 2005/0247015 A1 Nov. 10, 2005

(51) Int. Cl.
*E04C 3/30* (2006.01)

(52) U.S. Cl. ..... 52/726.4; 52/745.17; 52/736.2; 52/146; 52/651.02; 52/514; 174/45 R

(58) Field of Classification Search ..... 52/146, 52/148, 150, 152, 514, 726.4, 697, 745.14, 52/745.17, 40, 651.02, 651.07, 736.2, 736.1, 52/651.01; 174/40 R, 40 CC, 40 TD, 43, 174/44, 45 R See application file for complete search history.

(56) References Cited

U.S. PATENT DOCUMENTS

| | | | | | |
|---|---|---|---|---|---|
| 253,743 | A | * | 2/1882 | Mensing | 254/387 |
| 1,235,999 | A | * | 8/1917 | Neeley | 254/134.3 PA |
| 1,877,241 | A | * | 9/1932 | Hultman | 174/45 R |
| 2,040,010 | A | * | 5/1936 | McMahon | 52/127.2 |
| 2,606,952 | A | | 8/1952 | Cofer et al. | |
| 3,540,111 | A | * | 11/1970 | Wainwright | 29/402.03 |
| 3,911,548 | A | | 10/1975 | Perry | |
| 4,092,079 | A | | 5/1978 | Swanson | |
| 4,484,430 | A | * | 11/1984 | Rossman | 52/726.1 |
| 5,205,101 | A | * | 4/1993 | Swan et al. | 52/650.1 |
| 5,337,469 | A | | 8/1994 | Richey | |
| 5,524,408 | A | | 6/1996 | Richey | |
| 5,623,786 | A | * | 4/1997 | DeMeyer | 52/6 |
| 5,964,068 | A | * | 10/1999 | O'Neill | 52/223.9 |
| 6,065,267 | A | * | 5/2000 | Fisher | 52/692 |
| 6,115,988 | A | * | 9/2000 | Reisdorff | 52/741.14 |
| 7,007,438 | B1 | * | 3/2006 | Shields et al. | 52/736.2 |

* cited by examiner

*Primary Examiner*—Richard E. Chilcot, Jr.
*Assistant Examiner*—William Gilbert
(74) *Attorney, Agent, or Firm*—Spencer Fane Britt & Browne LLP

(57) ABSTRACT

A method and apparatus is provided for replacing a pole in an electrical utility support structure while the supported electrical wires remain energized. The method comprises erecting a replacement pole adjacent to a pole to be replaced, and providing a pivotable support arm on the replacement pole so that it will be engageable with the cross arm support carrying the electrical wires of the utility support structure. The support arm is adapted to lift and support the cross arm, whereupon the replaced pole may be disengaged from the cross arm and removed. A guy wire provides support for maintaining the load weight of the cross arm laterally on the replacement pole. The guy wire helps to transfer the supported load centrally on the replacement pole to prevent the supported weight from causing the replacement pole to lean. Mounting brackets are provided for attachment to the replacement pole which provide a base for connection and pivoting of the support arm.

16 Claims, 6 Drawing Sheets

METHOD AND APPARATUS FOR REPLACING A UTILITY POLE

BACKGROUND OF THE INVENTION

The invention relates to utility pole structures and their maintenance. More specifically, the invention relates to a method of replacing utility poles and apparatus for preparing replacement poles.

One common pole structure for supporting overhead electrical utility wires comprises a pair of spaced apart vertical poles joined at their upper ends by a cross arm which together form an H-structure. A series of H-structures are placed along the layout of the electrical wires, with the wires being supported on the cross arms at the upper ends of the poles. The poles are typically composed of wood, and, therefore, are subject to deterioration and damage. Because individual poles become deteriorated or damaged at different rates, it is generally necessary to repair or replace only one of the two poles of the H-structure at any one time. When such single-pole repair occurs, the overhead electrical wires normally remain suspended while the damaged pole is replaced. The damaged pole is first removed from the structure, and then the new pole is erected in the same place in the ground that the old pole was removed from.

Pole replacement is extremely hazardous because of the high voltage of the electrical wires. Because of that, extreme caution must be exercised and safeguards must be employed to minimize the danger to the replacement crew. In most instances, the power to the electrical lines is first shut off to prevent electrocution of any of the workers. High lift equipment must then be used to support the de-energized wires while the pole is being replaced. The observance of these safety measures, however, entails the use of numerous pieces of equipment and a crew of four to six workers. Furthermore, the job can take five to eight hours to complete.

SUMMARY OF THE INVENTION

By means of the instant invention, there is provided an apparatus and method for in-situ replacement of a pole in an electrical utility wire H-frame structure while permitting the electrical wires to remain energized. The method involves erecting a replacement pole adjacent to the pole to be removed such that the plane formed by the old and new pole is parallel to the directional run of the electrical wires. A support arm is pivotably mounted towards the top end of the replacement pole at a position to engage the underneath side of the cross arm member of the H-frame structure. A support bracket laterally mounted on the replacement pole provides a base on which the support arm may be mounted and about which the support arm may rotate. This enables the support arm to be raised underneath the utility wire cross arm and impart a lifting motion thereto. The support arm sustains the weight load of the cross arm and the wires that it carries. Once the weight load of the cross arm is placed on and secured to the support arm of the replacement pole, the damaged pole can be removed in a manner which avoids contact with the electrical wires. The cross arm is then left laterally supported on the replacement pole. Supplementary supports can be placed underneath the support arm to help maintain the weight of the suspended cross arm.

To provide a lifting force to the support arm, a guy wire is attached to the support arm. The guy wire also enables the laterally-disposed weight load of the supported cross arm to be transferred centrally on the replacement pole by securing the end of the guy wire to a remote position and using the point of attachment of the support arm to the mounting bracket as a fulcrum.

It is therefore an object of the invention to provide an apparatus for attachment to a utility pole to facilitate the replacement of poles in an electrical utility wire support structure. It is also an object of the invention to provide a method for the installation of a replacement utility pole. It is further yet an object of the invention to provide a method for replacement of a utility pole which avoids the necessity of de-energizing the electrical wires suspended on the support structure while the replacement operation proceeds.

These and other objects of the present invention are realized in the preferred embodiment of the present invention, described by way of example and not by way of limitation. Additional objects, advantages and novel features of the present invention will be set forth in the description which follows.

DESCRIPTION OF THE INVENTION

Figure 1:
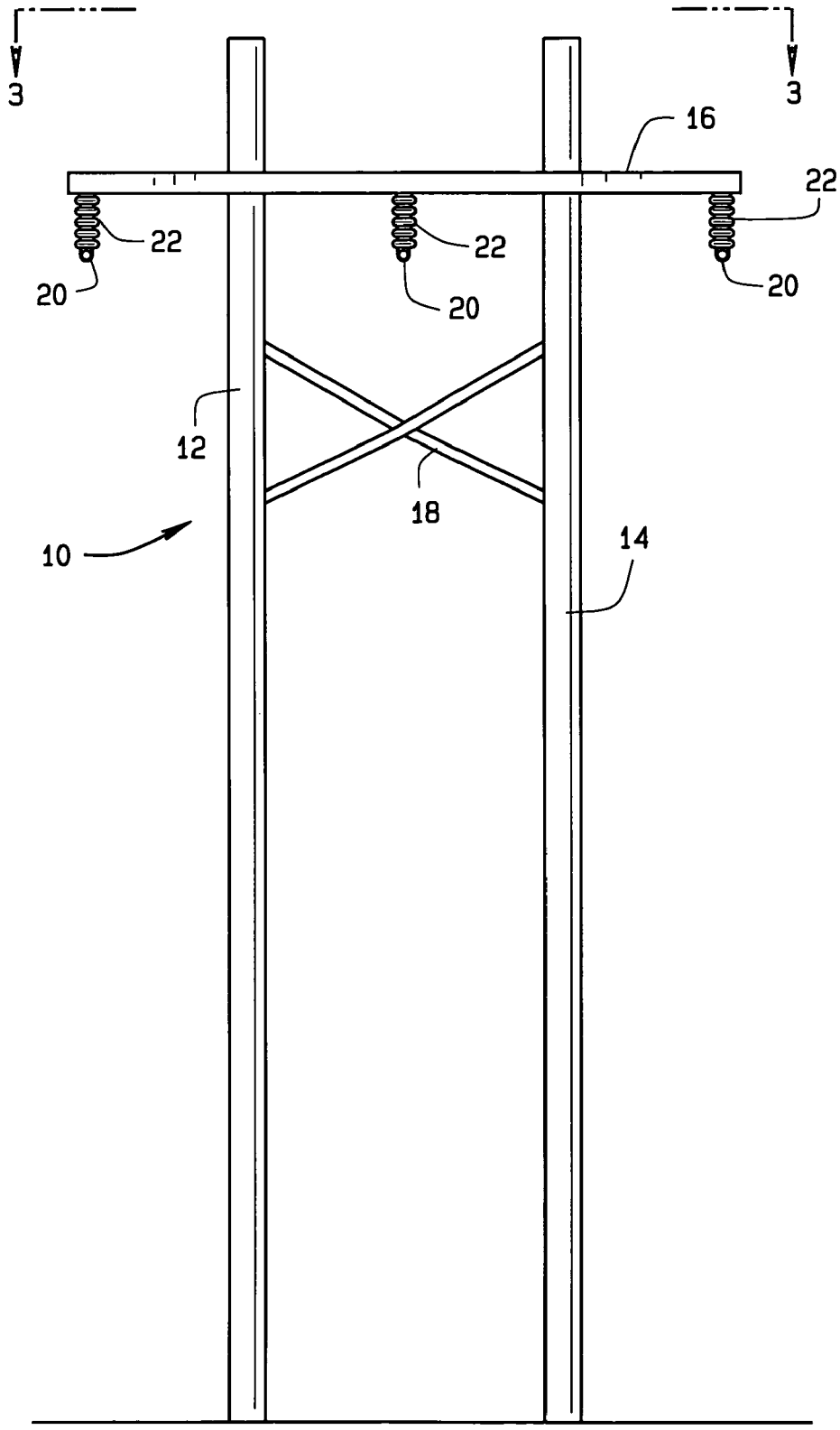
FIG. 1 is a view in side elevation taken from the rear of an H-frame utility wire structure.
Figure 2:
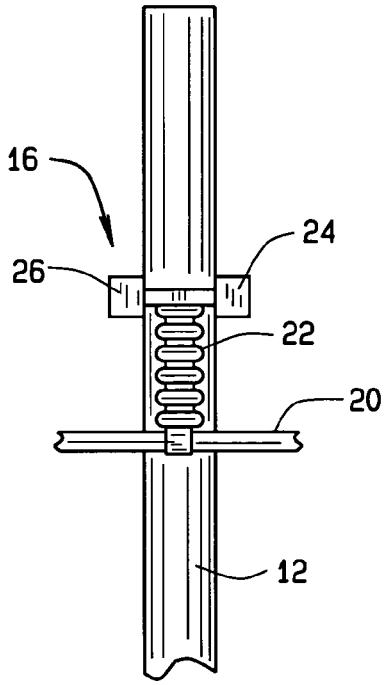
FIG. 2 is a view in side elevation taken from the side of an H-frame utility wire structure.
Figure 3:
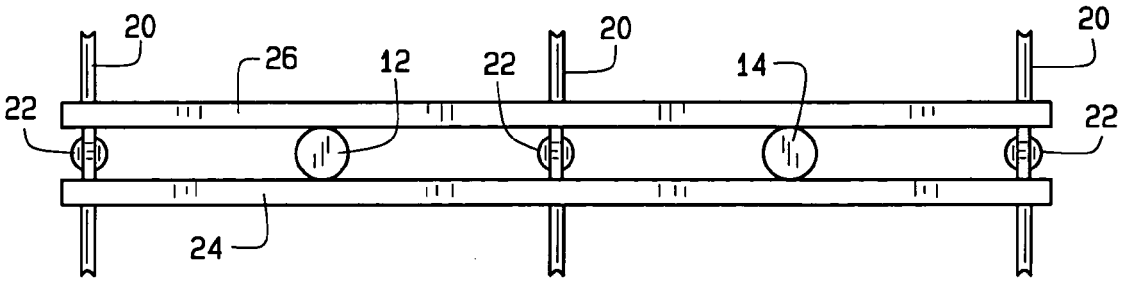
FIG. 3 is a top plan view of an H-frame utility wire structure taken along line 3-3 in FIG. 1.
Figure 4:
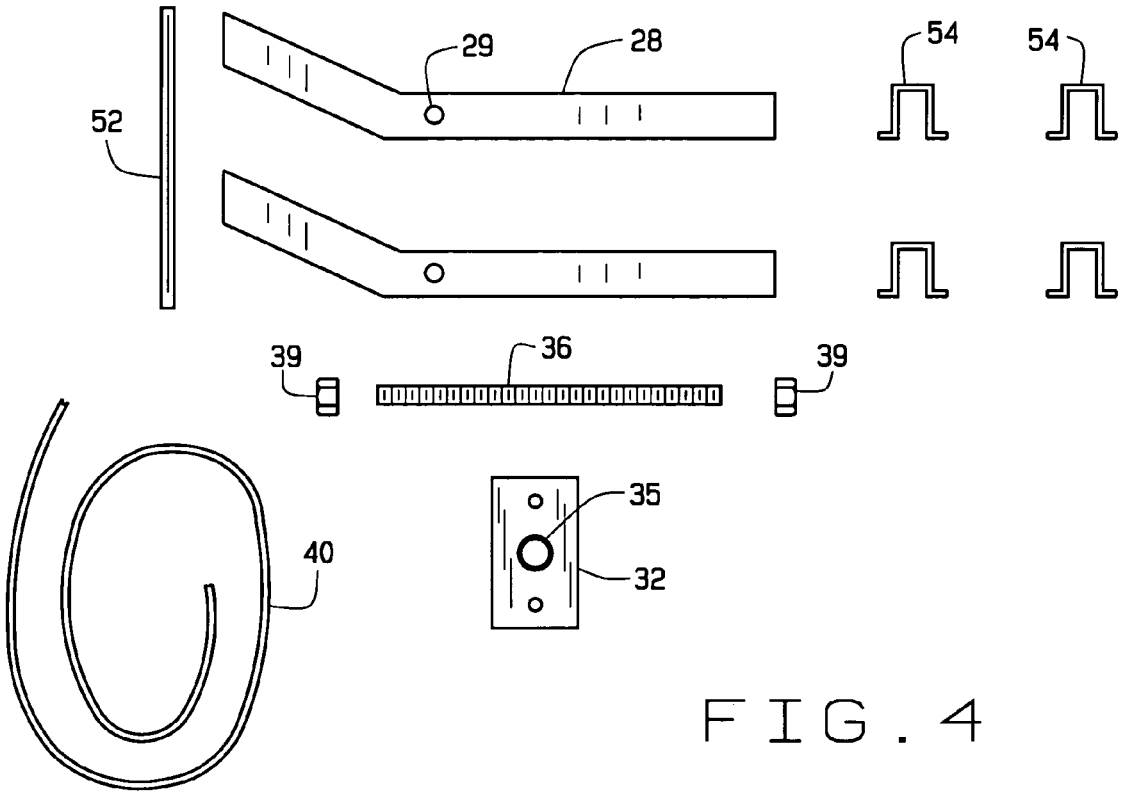
FIG. 4 shows the components of the pole replacement kit if the instant invention.

FIG. 1 shows an electrical utility wire H-structure, generally referred to by reference number 10. It comprises a pair of poles 12 and 14, a cross arm support 16, and cross braces 18. The electrical wires 20 are supported from cross arm support 16 by suspension insulators 22. As shown in FIGS. 2 and 3, cross arm support 16 is comprised of parallel members 24 and 26 which straddle poles 12 and 14. The electrical wires 20 run perpendicularly to the cross arm support 16, and are positioned on the outboard sides of the poles and in between the poles. It is well understood that there would be a substantial number of such H-structure units needed to support the electrical wires over their service distance.

Because the poles 12 and 14 are generally composed of wood, they are subject to deterioration, rot and other damage and must be periodically replaced. However, the relative positioning of the cross arm support 16 and wires 20 to the poles make the replacement process difficult and dangerous.

Given the restricted working space, it is practically impossible to take down the pole without hitting the adjacent wires. Prior art replacement methods involved first de-energizing the electrical wires, then spreading apart the individual members 24 and 26 of the cross arm support 16, holding the wires away from the structure, and then cutting down the pole, so that a new pole could be erected in its exact same spot.

The instant invention permits a replacement pole to be erected adjacent to the pole to be replaced, while initially leaving the pole to be repaired in place. A support and lifting arm is adapted to be mounted on the replacement pole which performs the dual function of lifting and supporting the cross arm laterally from the replacement pole. The damaged pole is left in place until the cross arm support and electrical wires are supported by and fastened to the support arm of the replacement pole. Once the replacement pole is erected and the cross arm support 16 is suspended from the support arm of the replacement pole, the old pole may be removed.

Figure 5:
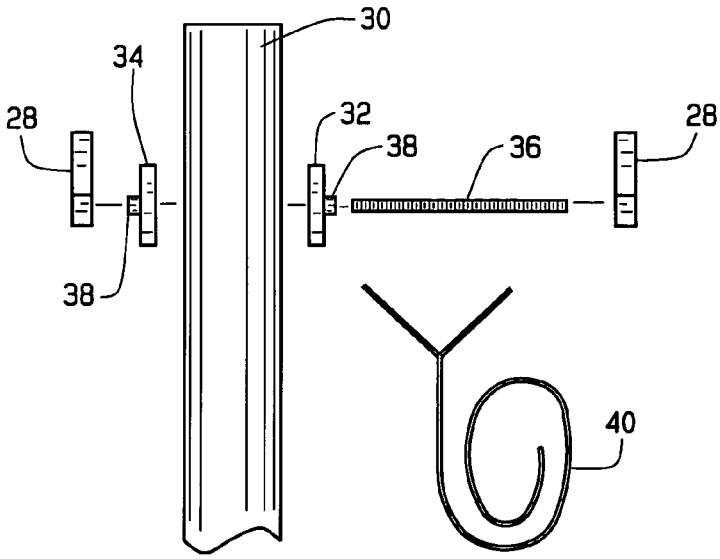
FIG. 5 is an exploded view of the component parts of the pole replacement kit in relation to a pole to be repaired.
Figure 6:
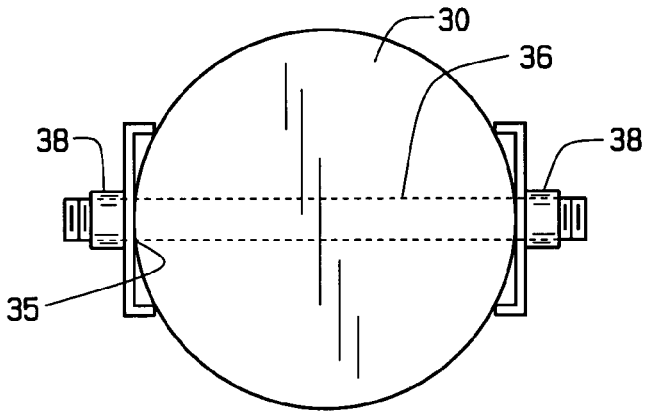
FIG. 6 is a top plan view of a pole with the support brackets mounted thereon.
Figure 7:
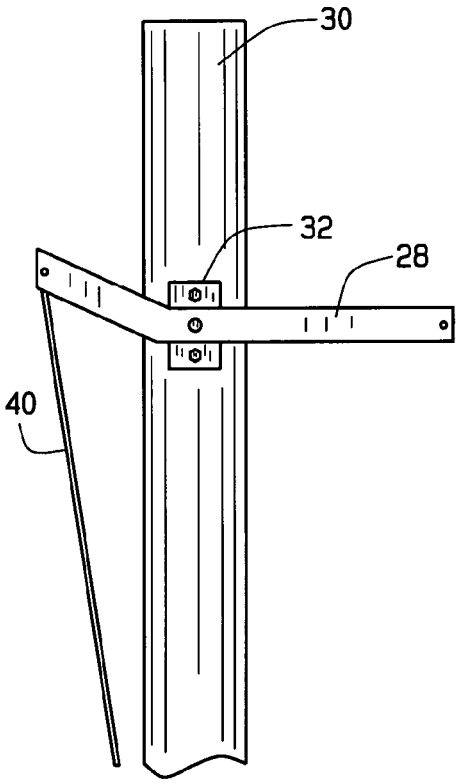
FIG. 7 is a view in side elevation from the side of a replacement pole having the support arms mounted thereon.
Figure 8:
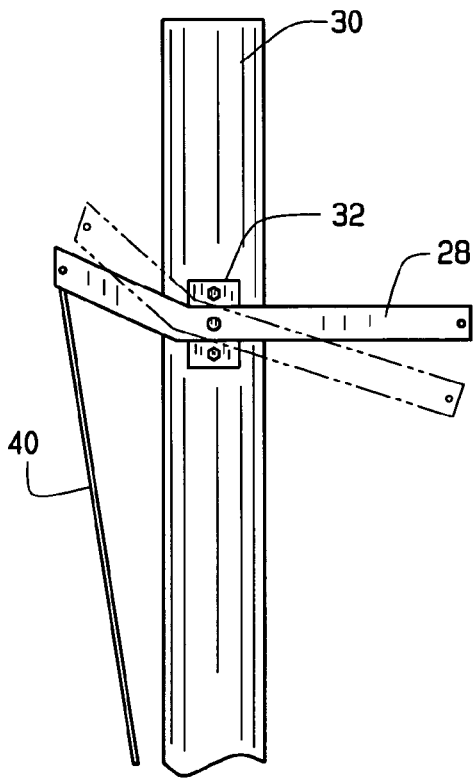
FIG. 8 is a view similar to FIG. 7, showing the pivoting relationship of the support arms to the pole.

A support arm 28 is installed on replacement pole 30 so that it is capable of providing both a lifting and a supporting function as shown in FIG. 8. Preferably, a pair of such support arms is employed, and they are placed on both sides of the replacement pole to provide a stable lifting and supporting force. Mounting brackets 32 and 34 are adapted to be connected to the sides of replacement pole 30 which provide a dual function of enabling support arms 28 to be attached to the replacement pole and to permit an even surface against which support arms 28 may pivot. As shown in FIGS. 5 and 6, each bracket has at least one aperture 35 which receives an elongated bolt 36. A hole is drilled through replacement pole 30 to receive bolt 36. For enhanced stability, additional apertures may be provided in the brackets to receive additional bolts passing through the pole. Bushings 38 are integrated into the exterior surface of each of the mounting brackets at the apertures which permit extended emergence of the ends of elongated bolt 36. Support arm 28 has an aperture 29 formed therein which permits placement of the support arm over the mounting plate bushing 38. This permits the support arm 28 to pivot about the mounting bracket 32 as shown in FIG. 8. A nut, collar or other fastener element 39 may be placed over the extending end of bolt 36 to retain the support arm in place on the mounting bushing. Each support arm 28 has an extended length of sufficient distance to reach under both elements 24 and 26 of cross arm 16. A guy wire 40 is provided for effecting a lifting force to the distal end of the support arm. A preferred point of attachment of the guy wire is to a proximal end of support arm 28 as shown in FIG. 7. This permits mounting bushing 38 to act as a fulcrum in lifting support arm 28. A linkage element 42 spanning between the distal ends of the pair of support arms 28 provides a point of connection of guy wire 40 thereto, with the distal end of guy wire 40 being adapted for securing to a support. Preferably, the support for the end of guy wire 40 is placed towards the bottom of replacement pole 30. As tension is placed on guy wire 40, support arms 28 pivot about mounting bushings 38 to provide a lifting and support force to cross arm 16. The load may be permanently sustained by securing the guy wire in place.

Use

Figure 11:
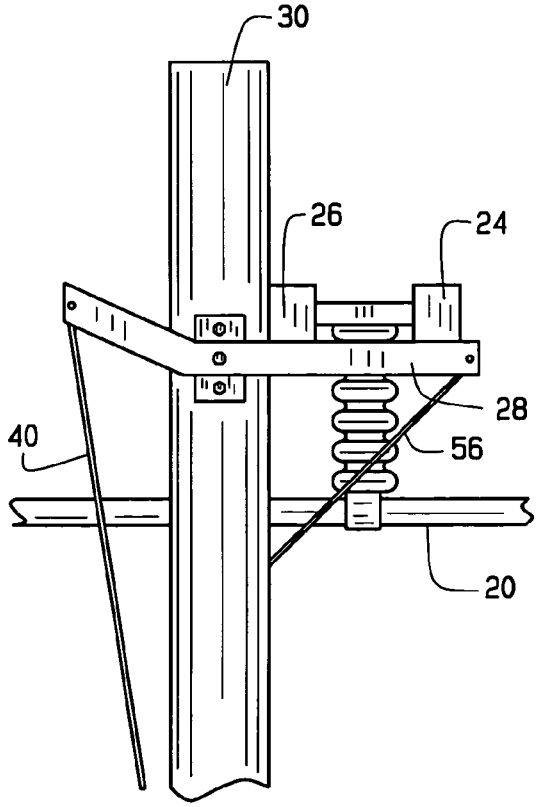
FIG. 11 is a view in side elevation of the replacement pole.
Figure 12:
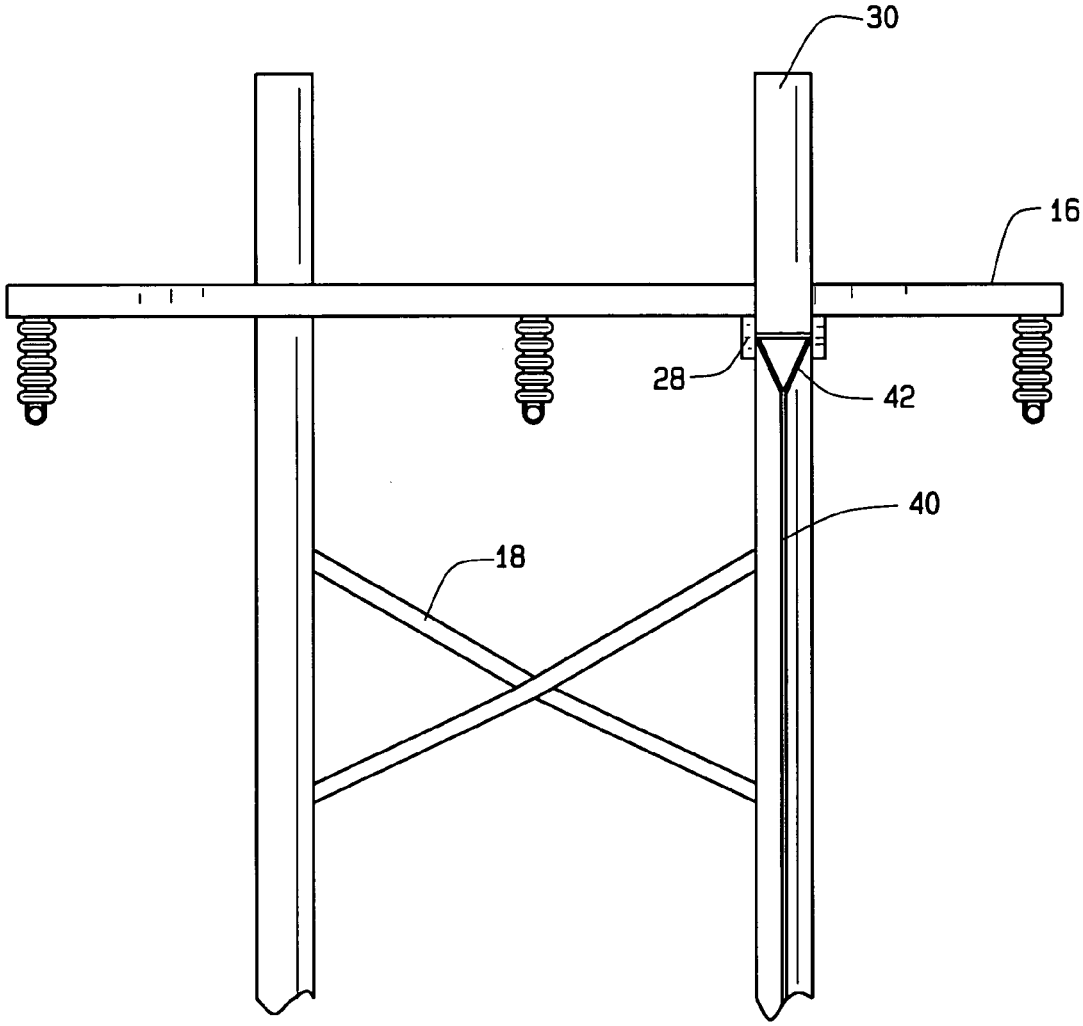
FIG. 12 is a view in side elevation from the rear of the H-frame utility wire structure with the replacement pole installed.

A preferred embodiment of the method of the instant invention is now described. A replacement pole 30 is erected adjacent to the existing bad pole 50 of an existing H-structure utility wire carrier. The replacement pole is placed behind the bad pole so that the alignment runs parallel with respect to the power lines 20. A single piece of high-lifting equipment to raise the worker to the level of the cross arm 16 is all that is required for the entire operation. No separate equipment is needed for de-energizing the wires or to hold the wires away from the work area. The mounting brackets 32 and 34 may be installed on replacement pole 30 before it is erected if the height at which the support apparatus must be mounted can be accurately estimated. Otherwise, a worker in a high-lift device can install the components after the replacement pole is erected in place. The mounting brackets are placed on either side of pole 30 at a height where the top edge of the mounted support arm 28 would be even with the bottom edge of the cross arms 24 and 26 as shown in FIG. 11. Each support arms 28 is then placed on the respective mounting bracket by aligning aperture 40 over mounting bushing 38 and securing a fastening collar over the extending end of bolt 36. This permits a rotational relationship of support arm 28 to the mounting bracket so that the end of the support arm may pivot up to provide a lifting and supporting force. The ends of support arms 28 are extended completely under members 24 and 26 of cross arm 16 which carry electrical wires 20. Spacer elements 52 may be attached to the proximal and distal ends of support arms 28 for stability and to maintain the support arms parallel to each other. Linkage element 42 is connected to the proximal ends of support arms 28 which provides a connection point for guy wire 40. The other end of guy wire 40 is secured to a remote location, such as the base of replacement pole 30.

Figure 9:
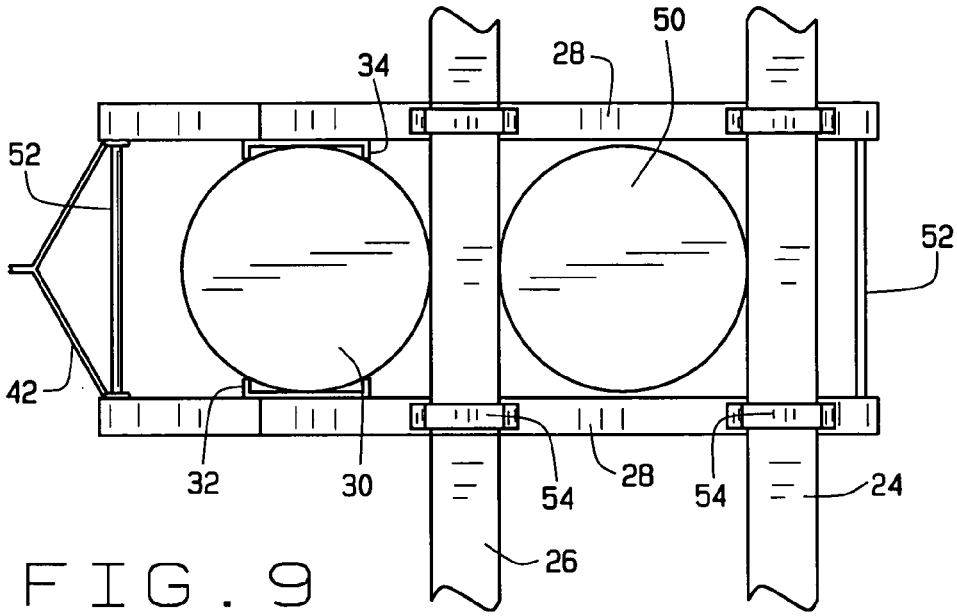
FIG. 9 is a top plan view of the replacement pole placed adjacent to the pole to be repaired.
Figure 10:
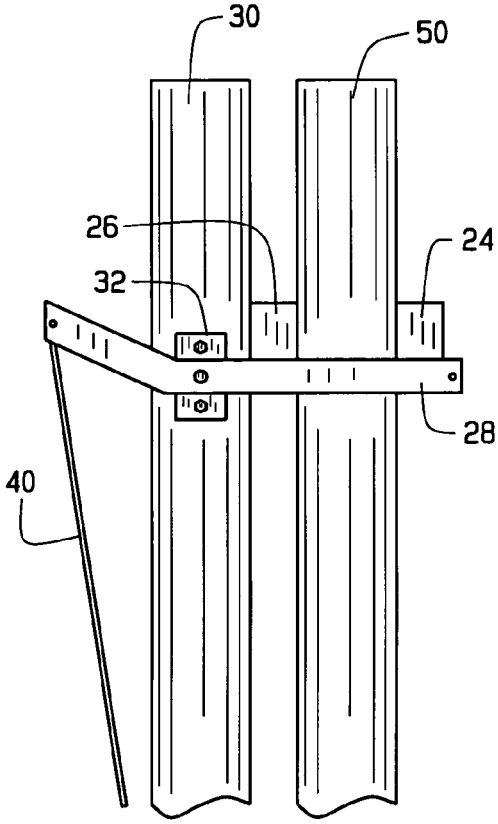
FIG. 10 is a view in side elevation of the replacement pole placed adjacent to the pole to be repaired.

Once the apparatus is installed on the replacement pole 30 as described, a chain hoist (or other tensioning device) is used to apply a downward force on guy wire 40. As the guy wire is tightened, the proximal end of support arm 28 is pulled down causing the support arm to rotate about mounting bushing 38, thus imparting a lifting action on the distal ends of support arms 28. This effectively transfers the weight of the cross arm 16 from the bad pole 50 to the replacement pole 30. This weight load may be permanently supported on support arms 28 by securing the end of the guy wire to the bottom of the pole as shown in FIG. 10. The elements 24 and 26 of cross arm 16 may be secured to support arms 28 with U-bolts 54 as shown in FIG. 9. The use of the guy wire and fulcrum provided by the mounting bushings 38 shift the laterally disposed weight of the supported cross arms at the side of replacement pole 30 towards the center of the pole, thus helping to prevent leaning of the replacement pole. A supplementary brace may also be provided to support the lateral load of the supported cross arms as shown in FIG. 11.

Once the replacement pole is installed, cross arm 16 may be disconnected from the old pole 50. The respective ends of cross braces 18 are switched from the old pole 50 to replacement pole 30. Once all hardware and connections are removed from the old pole 50, it can be sawed into sections and safely removed from the structure. If desired, however, the old pole may be kept in place unless it presents a hazard. It is also conceivable that the replacement pole may be used merely as a supplementary support to the old pole.

The invention can be employed in the field in a number of ways. The hardware components may be provided as a kit, which can be brought to the work site independently of the replacement poles. Installation may then take place at the work site at the time of repair. Alternately, it may be desirable to have replacement poles prefabricated with the hardware attached to save additional time in installation.

The invention permits the replacement of utility poles without having to first de-energize the electrical wires or to first bring down the damaged pole. The in-situ replacement is accomplished in an efficient manner in a minimal work area. This makes the repair job capable of being accomplished by no more than two workers using a single piece of high-lift equipment. In particular, there is no need for multiple pieces of high-lift equipment and extra workers, which would otherwise be needed to spread and hold back the wires during the replacement operation. It can be understood that such efficiency in equipment and manpower can lead to substantial savings in the energy industry.

Various changes and modifications may be made within this invention as will be apparent to those skilled in the art. Such changes and modifications are within the scope and teaching of this invention as defined in the claims appended hereto.

What is claimed is:

1. A method for replacing a pole of a utility wire support structure of the type comprising an H-frame arrangement of at least two vertical poles supporting a cross arm member on which overhead electrical wires are carried transversely to a plane defined by said H-frame arrangement, said method comprising steps for:

a) erecting a replacement pole adjacent to a standing pole to be repaired and transversely to said plane defined by said H-frame arrangement, b) providing a support arm member on said replacement pole, c) placing said support arm member into position to transfer support of said cross arm member from said standing pole to be repaired to said replacement pole, said support arm member being adapted to provide variable lifting support to said cross arm member, d) removing said pole to be repaired once said cross arm member is supportively engaged on said support arm member laterally of said replacement pole, said support arm being pivotally attached to said replacement pole to adapt said support arm for lifting said cross arm member from its supportive position on said pole to be repaired.

2. The method of claim 1 in which a guying mechanism is connected to said support arm, said guying mechanism being adapted to apply a lifting force to said support arm.

3. The method of claim 2 in which said guying mechanism is anchored at a base end of said replacement pole.

4. The method of claim 1 in which said support arm is pivotally attached to said replacement pole to adapt said support arm for lifting said cross arm member from its supportive position on said pole to be repaired, a guying mechanism being connected to said support arm, said guying mechanism being adapted to apply a lifting force to said support arm, said guying mechanism being anchored at a base end of said replacement pole, and a weight load of said cross arm member being supported centrally and vertically on said replacement pole.

5. A method for preparing a replacement pole for use in a utility wire support structure of the type comprising an H-frame arrangement of at least two vertical poles supporting a cross arm member on which overhead electrical wires are carried transversely to a plane defined by said H-frame arrangement, said method comprising steps for:

a) adapting said replacement pole to have a support arm member extending laterally therefrom at a height approximating a location of said cross arm member on a pole to be repaired, b) adapting said support arm member to pivot about its connection to said replacement pole, c) erecting said replacement pole adjacently to a standing pole to be repaired and transversely to said plane defined by said H-frame arrangement, d) placing said support arm member under said cross arm member from said standing pole to be repaired, e) lifting of said support arm member, whereby said cross arm member may become supportively engaged on said support arm member laterally of said replacement pole.

6. The method according to claim 5 in which a guying mechanism is attached to said support arm member to adapt said support arm member to be lifted by pivoting about its connection to said replacement pole.

7. The method according to claim 6 in which said guying mechanism is secured at a point remote from said pivotable connection of said support arm member to said replacement pole to transfer a weight load of said laterally positioned cross arm member centrally and vertically on said replacement pole.

8. A kit for preparing a replacement pole for use in a utility wire support structure of the type comprising an H-frame arrangement of at least two vertical poles supporting a cross arm member on which overhead electrical wires are carried transversely to a plane defined by said H-frame arrangement, said kit comprising:

a) a support arm adapted to be mounted to said replacement pole, b) a pivot pin adapted to be connected to said replacement pole, and c) a guying mechanism, said support arm having an extended length, said support arm being adapted for mounting over said pivot pin so that said support arm is adapted for rotation about said pivot pin to a lateral orientation with respect to said replacement pole, said guying mechanism being adapted for connection to said support arm to effect a lifting motion thereto, said guying mechanism being further adapted to maintain said lifting motion whereby said support arm is able to sustain a weight of said cross arm member when extended laterally from said replacement pole.

9. The kit of claim 8 in which said guying mechanism is adapted for attachment to a proximal end of said support arm, a distal end of said support arm is adapted for lifting said cross arm member, a free end of said guying mechanism being adapted for attachment to an element remote from said support arm, said guying mechanism being adapted to pull said proximal end of said support arm to effect said lifting motion to a distal end of said support arm by rotation about said pivot pin.

10. The kit of claim 9 in which said proximal and distal ends of said support arm and said guying mechanism are configured to place a weight load from said cross arm centrally on said replacement pole when said guying mechanism pulls on said proximal end of said support arm.

11. The kit of claim 8 in which said support arm comprises two elongated bars adapted to be positioned on opposite lateral sides of said replacement pole, said pivot pin having a sufficient length to span a diameter of said replacement pole such that its ends are adapted to protrude a distance on either side of said replacement pole, said elongated bars each having an aperture along their midpoint adapted to receive said ends of said pivot pin.

12. A replacement pole for use in a utility wire support structure of the type comprising an H-frame arrangement of at least two vertical poles supporting a cross arm member on which overhead electrical wires are carried transversely to a plane defined by said H-frame arrangement, said replacement pole comprising:

a) a support arm, b) a pivot pin, and c) a guying mechanism, said support arm having an extended length, said pivot pin extending from a side of said replacement pole towards a top end of said replacement pole, said support arm being mounted over said pivot pin so that said support arm is rotatable about said pivot pin in a lateral orientation with respect to said replacement pole, said guying mechanism being connected to said support arm and is adapted to effect a lifting motion thereto, said guying mechanism being further adapted to maintain said lifting motion whereby said support arm is able to sustain a weight of said cross arm member laterally from said replacement pole.

13. The replacement pole of claim 12 in which said guying mechanism is attached to a proximal end of said support arm, a distal end of said support arm being adapted for lifting said cross arm member, a free end of said guying mechanism being adapted for attachment to an element remote from said support arm, said guying mechanism being adapted to pull said proximal end of said support arm to effect said lifting motion to a distal end of said support arm by rotation about said pivot pin.

14. The replacement pole of claim 13 in which proximal and distal ends of said support arm and said guying mechanism are configured to place a weight load from said cross arm centrally on said replacement pole when said guying mechanism pulls on said proximal end of said support aim.

15. The replacement pole of claim 14 in which said free end of said guying mechanism is attached to a base of said replacement pole on a side opposite from said distal ends of said support arm.

16. The replacement pole of claim 12 in which said support arm comprises two elongated bars positioned on opposite lateral sides of said replacement pole, said pivot pin having a sufficient length to span a diameter of said replacement pole such that its ends protrude a distance on either side of said replacement pole, said elongated bars each having an aperture along their midpoint adapted to receive said ends of said pivot pin.

* * * * *